US005335462A

United States Patent [19]

Park

[11] Patent Number: 5,335,462

[45] Date of Patent: Aug. 9, 1994

[54] BUILDING STRUCTURE

[75] Inventor: Owen H. Park, Carmel, Ind.

[73] Assignee: Heartland Industries, Inc., Carmel, Ind.

[21] Appl. No.: 4,703

[22] Filed: Jan. 14, 1993

[51] Int. Cl.[5] ..... E04B 1/74

[52] U.S. Cl. ..... 52/95; 52/92.1; 52/93.2; 52/94

[58] Field of Search ..... 52/92.1, 93.2, 94–96

[56] References Cited

U.S. PATENT DOCUMENTS

| | | | |
|---|---|---|---|
| 1,504,454 | 8/1924 | Tyson . | |
| 2,495,966 | 1/1950 | Haines . | |
| 2,880,470 | 4/1959 | Pickersgill . | |
| 2,902,733 | 9/1959 | Justus . | |
| 3,082,492 | 3/1963 | Grubb . | |
| 3,160,987 | 12/1964 | Pinkley . | |
| 3,293,808 | 12/1966 | Duncan . | |
| 3,477,184 | 11/1969 | Johnson et al. . | |
| 3,683,785 | 8/1972 | Grange | 52/92 X |
| 3,797,180 | 3/1974 | Grange | 52/95 X |
| 3,863,553 | 2/1975 | Koontz | 52/95 X |
| 3,972,164 | 8/1976 | Grange | 52/95 |
| 4,102,092 | 7/1978 | Ward | 52/95 X |
| 4,115,967 | 9/1978 | Kragt . | |
| 4,189,878 | 2/1980 | Fitzgerald | 52/94 X |
| 4,214,510 | 7/1980 | Ward | 52/92.1 X |
| 4,269,007 | 5/1981 | Ward | 52/95 |
| 4,481,744 | 11/1984 | Park | 52/92.1 |
| 4,527,981 | 7/1985 | Chisum . | |
| 4,573,293 | 3/1986 | Park . | |
| 4,701,131 | 10/1987 | Hildebrandt et al. . | |
| 4,702,149 | 10/1987 | Speer | 52/95 X |
| 4,776,262 | 10/1988 | Curran | 52/95 X |
| 4,894,963 | 1/1990 | Campbell . | |

*Primary Examiner*—Carl D. Friedman
*Assistant Examiner*—Beth A. Aubrey
*Attorney, Agent, or Firm*—Barnes & Thornburg

[57] ABSTRACT

A building structure includes outer walls, a roof having a lower border that overhangs one or more of the outer walls, and a frame for supporting the outer walls and roof. A top frame member is secured to the frame, extending longitudinally, and forms a portion of the outer side walls. A wall panel is received in a bottom edge of the top frame member and a board member having holes therein is received in a top portion of the top frame member. The board member, top frame member and wall panel form the outer side wall of the building. Rafter tails are also mounted to the frame, and overhang the outer side wall and top frame member. The rafter tails are covered by an overhang deck and a facia board. Air is allowed to enter the chamber formed between the rafter tails, overhang deck and facia board and pass through the board member into the building structure, thus providing a flow of air into the building.

19 Claims, 2 Drawing Sheets

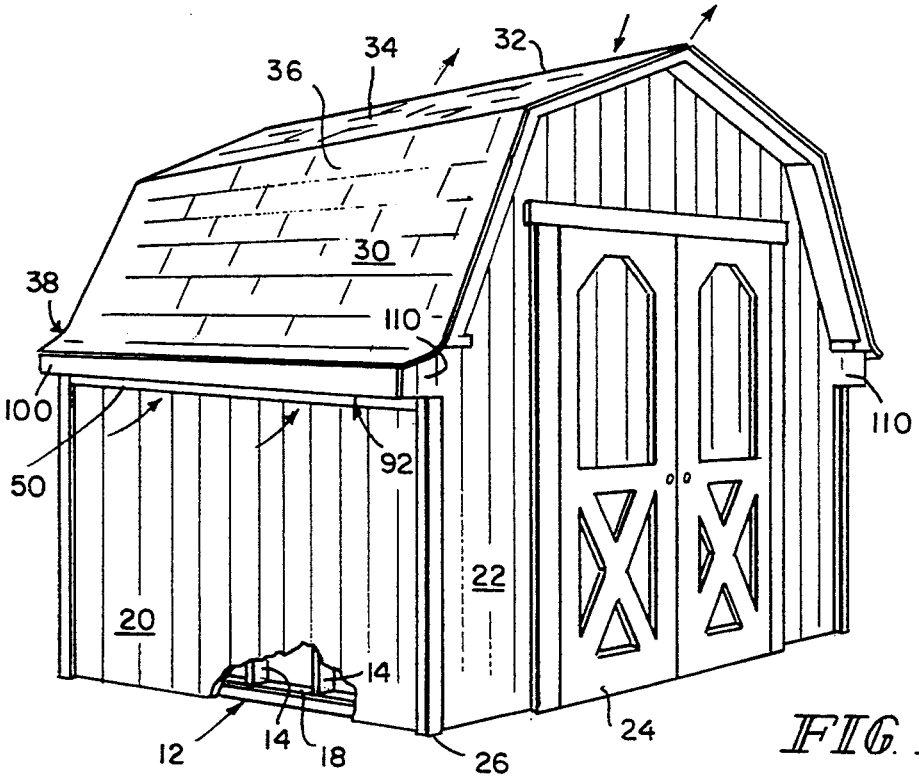
FIG. 1
FIG. 2
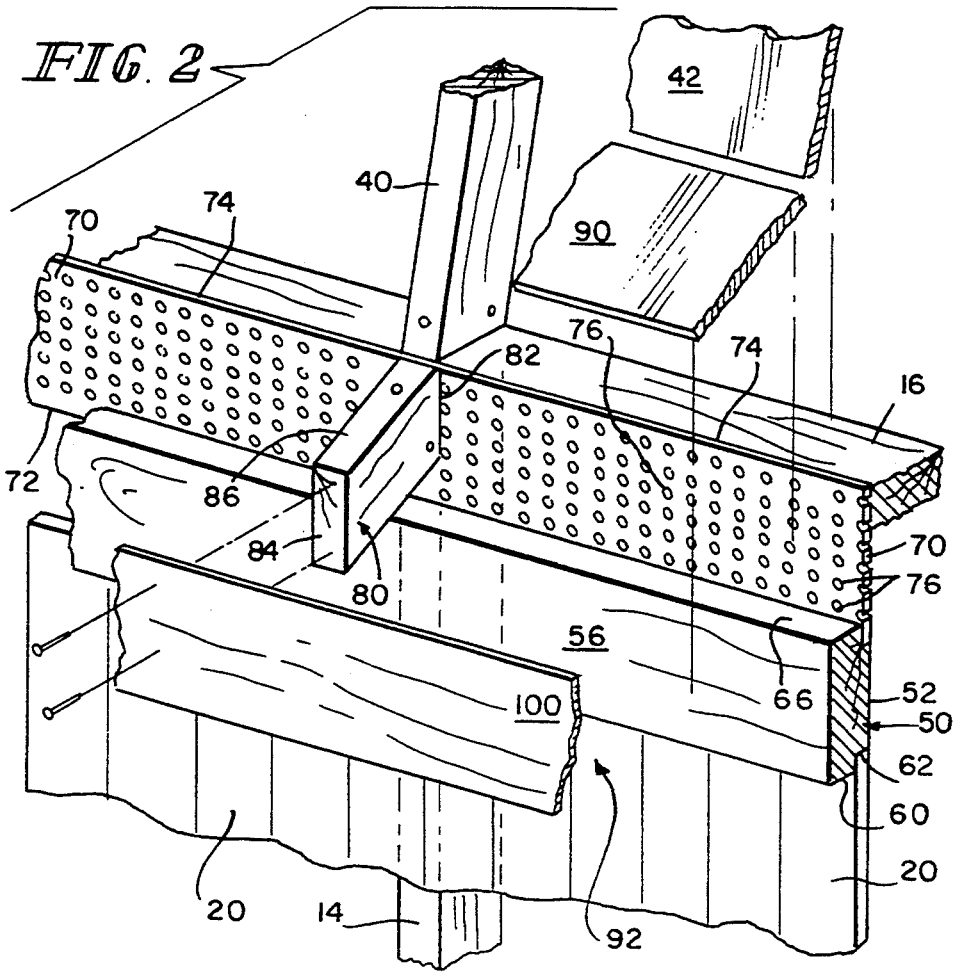

BUILDING STRUCTURE

BACKGROUND AND SUMMARY OF THE INVENTION

The present invention relates to building structures, and more particularly to improvements which strengthen and straighten the building structure framework, reduce waste of building materials, allow for creative building structure design, and allow for aeration of the building structure.

Several problems are typically associated with the construction of building structures. One such problem is the efficient utilization of building materials to reduce waste. Reducing the waste of building materials increases the overall efficiency of construction, and reduces the overall cost of the building. By maximizing utilization of building materials, more buildings can be constructed at a lower cost.

A second problem associated with building structures is providing a passage for airflow from the ambient into and through the building. In structures used primarily for storage, the building may contain no windows or vents to allow air to pass therethrough. Therefore, moisture may be trapped within the building structure, which can cause items being stored therein to deteriorate. Furthermore, continued moisture build-up in the building structure can cause deterioration to the building itself. Moisture build-up is particularly problematic in climates where there are prolonged periods of high temperature and humidity.

A further problem associated with building structures is the limitation of available design features. This is particularly so with building structures used primarily for storage. Because of the need to limit construction costs, certain design choices may be sacrificed.

Therefore, it is one object of the present invention to provide a building structure which reduces building material waste while strengthening the structure of the building.

Another object of the present invention is to provide a building structure which provides for aeration of the building.

A further object of the present invention is to provide a building structure which increases design flexibility and provides for decorative design options for the building.

These and other objects are achieved in a building which includes outer walls, a roof having a lower border that overhangs one or more of the outer walls, and a frame for supporting the outer walls and roof. The present invention includes a top frame member which forms a portion of the outer sidewall beneath the overhanging roof border. The top frame member includes a rabbet in its bottom surface, for receiving a wall panel therein. The top frame member also includes a rabbet in its top surface, for receiving a board member having a plurality of holes therein. The board member, top frame member and wall panel combine to form the outer wall of the building structure. In the illustrative embodiment, the top frame member and the board member have a width sufficient to allow construction of a building having an outside wall that is 4½ feet high utilizing a wall panel that is 3½ feet high, and a building having an outer wall that is 5½ feet high utilizing a wall panel that is 4½ feet high. Thus, a sheet of building material that is 8 feet in length can be cut to provide wall panels for both buildings without waste.

The top frame member is secured transverse to frame studs of the building structure, thereby increasing the strength of the building structure. The top frame member also supports a rafter tail, which is further secured to the studs. A plurality of rafter tails are utilized, and extend outwardly over the top frame member and the outside wall. The length of the rafter tails may be increased or shortened, and thus the design of the lower border portion of the roof may be modified.

The rafter tails are substantially covered by an overhang deck and a facia board. This construction further provides the building structure of the present invention with a unique design.

Underneath the facia board and the rafter tails, air is allowed to pass into the building. Air flows from beneath the rafter tails, through the holes in the board member, and into the building structure. The air is allowed to escape through vents in the roof. Thus, air is allowed to pass from the ambient into the building structure and exit the structure back into the atmosphere.

Various additional features and advantages of the present invention will become apparent in view of the following detailed description of one embodiment exemplifying the best mode of carrying out the invention as presently perceived, which embodiment should be considered in conjunction with the accompanying drawings.

BRIEF DESCRIPTION OF THE DRAWINGS

FIG. 1 is a perspective view of a building structure embodying the present invention.

FIG. 2 is a fragmentary partial exploded view of a building structure of the present invention.

DETAILED DESCRIPTION OF THE DRAWINGS

Figure 3:
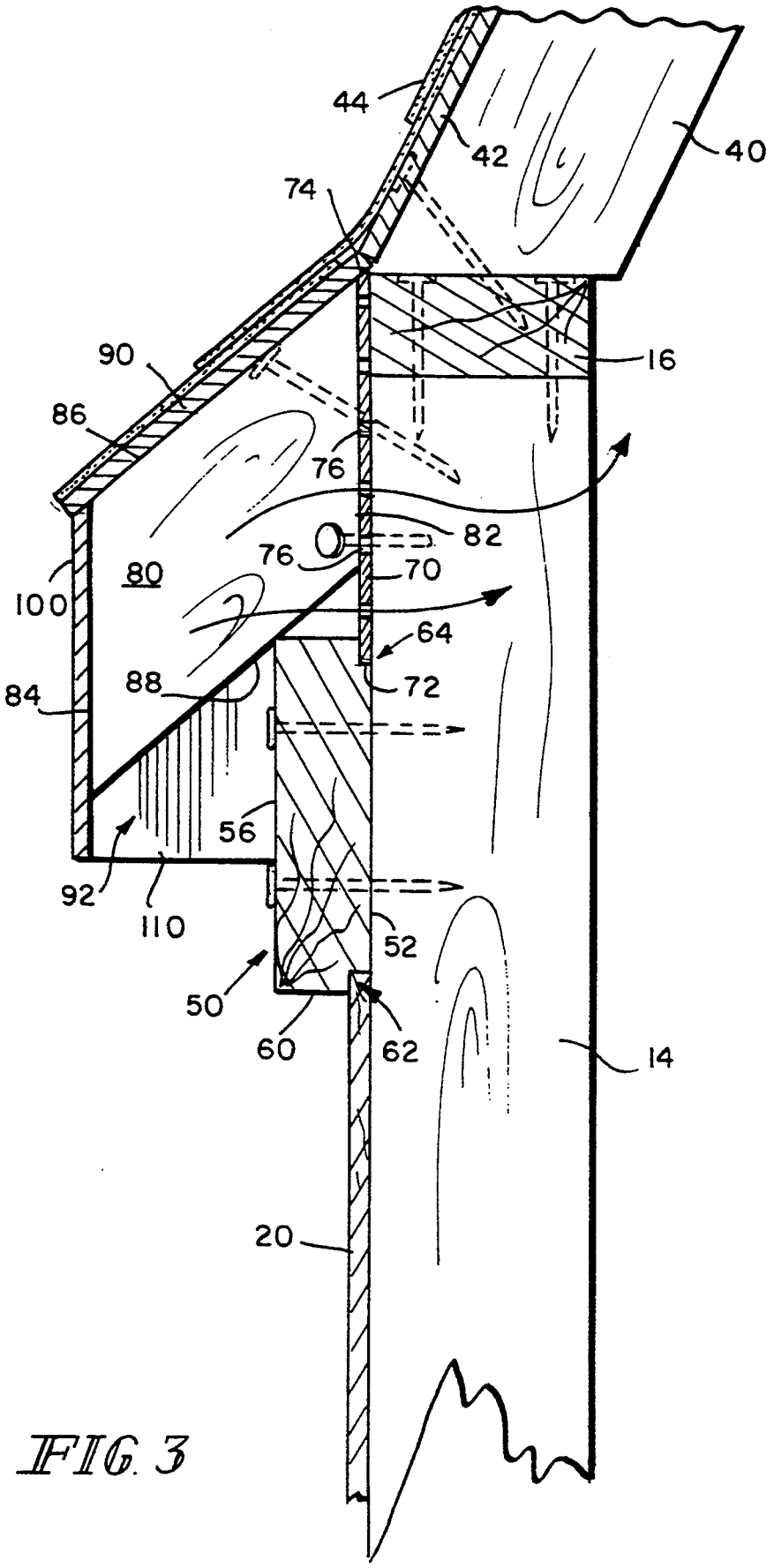
FIG. 3 is a fragmentary cross-sectional view of the lower border portion of the roof and upper portions of the outer side wall of a building of the present invention.

Referring now to the drawings, in which like-referenced characters indicate corresponding elements throughout the several views, attention is first directed to FIG. 1 which illustrates an embodiment of a building structure according to the present invention, indicated generally by the reference numeral 10. Building structure 10 comprises frame 12 having a plurality of vertical studs 14, and horizontal top and bottom plates 16 and 18, respectively, which support studs 14 in spaced-apart vertical relationship. Wall panels 20 and end panels 22 are secured to frame 12 using nails or other conventional means, and roof 30 is similarly mounted to the frame to enclose the structure. Door 24 is provided in one end panel 22, allowing access to the interior of building structure 10. Face boards 26 may be used at the corners of the structure to conceal the ends of wall panels 20 and end panels 22. Generally speaking, the above-described structural members of building structure 10 are constructed of wood. However, other materials could be used without departing from the scope of the present invention.

In the illustrative embodiment of building structure 10, roof 30 is a curb roof having a double slope on each of its two sides. Roof 30 includes center ridge 32, an upper section 34 having a first slope, and lower section 36 having a second slope. In comparison, upper section 34 has a flatter slope, and lower section 36 has a steeper slope. Roof 30 also includes lower border 38 which overhangs wall panels 20 on the two longitudinal sides of building structure 10. Lower border 38 has a gradual slope in comparison to the slopes of the upper and lower sections 34 and 36.

Roof 30 includes a plurality of rafters 40, decking 42 secured to rafters 40, and shingles 44 covering decking 42. This arrangement can be best seen in FIG. 3. As shown in the various figures, rafters 40 may include a plurality of wooden beams having the approximate dimensions of 2 inches by 4 inches, and decking 42 may have a thickness of approximately ½ inch. The specific dimensions of the various components are not critical to the present invention, since certain structural elements may be modified without departing from the scope of the present invention. Furthermore, certain structural elements are common to most buildings, such as, for example, frame 12, wall panels 20, end walls 22, and roof 30. The present invention is directed to structural features which may be adapted to various buildings having these structural elements. Thus, it is not intended that the present invention be limited to any specific building or type of roof.

In addition to the elements previously recited, the present invention also includes a new structural means for providing lower border 38 of roof 30, such that the border forms an overhang over the outer wall of the building. Referring now to FIGS. 2 and 3, top frame member 50 extends longitudinally, and includes inner surface 52 which engages vertical studs 14. Top frame member 50 is secured to studs 14 by conventional means, such as nails. In the preferred embodiment shown, top frame member 50 is an elongated wooden board having cross-sectional dimensions of approximately 2 inches by 6 inches. Top frame member 50 also includes outer surface 56 which forms a portion of the outer side wall of building structure 10.

Bottom edge 60 of top frame member 50 includes first rabbet 62 cut therein. Rabbet 62 is cut out of bottom edge 60 and inner surface 52 of top frame member 50. In the embodiment shown, rabbet 62 has dimensions of approximately ½ inch by ⅝ inch, and extends longitudinally within top frame member 50. Rabbet 62 receives a top edge of wall panel 20 therein. Rabbet 62 is designed to receive wall panel 20 having a thickness of approximately ⅝ inch, but it can be readily appreciated that the dimensions of rabbet 62 and wall panel 20 may be varied. Once inserted into rabbet 62, panel 20 is secured to studs 14 in a conventional manner. Panel 20 combines with top frame member 50 to form a portion of the outside wall of building structure 10.

Opposite rabbet 62, top frame member 50 includes second rabbet 64. Rabbet 64 is cut out of top edge 66 and inner surface 52 of top frame member 50. In the embodiment shown, rabbet 64 has dimensions of approximately ¼"×½", and extends longitudinally within top frame member 50.

Rabbet 64 receives bottom edge 72 of board member 70 therein. Rabbet 64 is designed to receive a portion of board member 70 having a thickness of approximately 7/16", but it can be readily appreciated that the dimensions of rabbet 64 and board member 70 may be varied. Board member 70 is preferably an elongated board of wooden or composite material, having approximate dimensions of ¼"×6". Bottom edge 72 of board member 70 is received within rabbet 64, and top edge 74 of board member 70 is disposed adjacent a distal end of decking 42. Board member 70 is secured to studs 14, and to top plate 16 in a conventional manner. Board member 70 includes a plurality of holes 76 therein, as can best be seen in FIG. 2. Holes 76 allow air to pass from the ambient into building structure 10. Board member 70 combines with top member 50 and wall panel 20 to form the outer side wall of building structure 10.

The present invention also includes a plurality of rafter tails 80. Each rafter tail 80 is generally rhomboidal in shape, and includes two pairs of parallel surfaces. Inner face 82 is substantially parallel to outer face 84, while top face 86 is substantially parallel to bottom face 88. Rafter tail 80 has dimensions of approximately two inches by six inches. Each rafter tail 80 is secured to stud 14 and top plate 16 in a conventional manner, such that inner face 82 rests substantially flush against the stud and top plate. In this position, rafter tail 80 is angled generally downwardly, at an angle from stud 14 approximately equal to the acute angle of the rhomboid. In the embodiment shown, the acute rhomboidal angle is approximately 50°. It should be well understood that this angle could be modified without departing from the scope of the present invention.

As can be seen in FIG. 3, rafter tail 80 is supported by and overhangs top frame member 50. In the embodiment shown, rafter tail 80 extends such that outer face 84 is substantially parallel to the outside wall of building structure 10, and is displaced approximately 4'4" inches from wall panel 20. However, it should be well understood that rafter tail 80 may be lengthened or shortened, so as to increase or decrease the amount of overhang over the outer side wall.

Overhang deck 90 extends from decking 42 and substantially covers the plurality of rafter tails 80. Overhang deck 90 is an elongated board, having approximate dimensions of 7/16"×6". Overhang deck 90 is secured to top face 86 of rafter tail 80 such that one edge of the overhang deck rests adjacent the interface between decking 42 and board member 70, and the opposite edge slightly overhangs outer face 84 of rafter tail 80. This can best be seen in FIG. 3. Shingles 44 may be secured to decking 42 and overhang deck 90 in a conventional manner.

Facia board 100 is attached to outer face 84 of rafter tails 80. Facia board 100 is preferably an elongated wooden board, having approximate dimensions of 7/16"×4½". Facia board 100 is attached to rafter tails 80 in a conventional manner, such as nails. The top edge of facia board 100 substantially abuts the overhanging edge of overhang deck 90, and extends downwardly, covering outer face 84 of rafter tail 80. The opposite edge of facia board 100 depends slightly below bottom surface 88 of rafter tail 80.

Successive rafter tails 80, in combination with adjacent portions of overhang deck 90 and facia board 100 form open chamber 92 therebetween. Air is allowed to enter chamber 92 from below rafter tails 80, adjacent top frame member 50. Air enters chamber 92 from the ambient, passes through holes 76 in board member 70, and into building structure 10. Air entering building structure 10 through holes 76 is allowed to escape the building structure through vents in center ridge 32 of roof 30. This flow of air is shown by the arrows in FIG. 1 and FIG. 3. In this manner, building structure 10 may be cooled and aerated.

The present invention also includes end face 110. End face 110 is secured at opposite ends of building structure 10, adjacent the overhanging portion of the roof. End face 110 gives building structure 10 a complete, finished appearance.

In addition to forming a portion of the outer side wall of building structure 10, top frame member 50 also increases the strength and rigidity of frame 12. Top frame member 50 is secured to studs 14 transverse to their vertical orientation. Thus, studs 14 remain erect and rigid, thereby increasing the overall strength of frame 12. Furthermore, top frame member 50 is secured to wall panels 20 and board member 70. These members are also secured to studs 14, thereby further increasing the rigidity of frame 12. Top frame member 50 also contacts and supports rafter tails 80, which are also secured to studs 14 and to top plate 16. This interaction of the various components further serves to strengthen frame 12.

The orientation of wall panel 20 within first rabbet 62 of top frame member 50 is also advantageous because of its ease of maintenance. If wall panel 20 becomes damaged or deteriorated, it can easily be replaced by pulling the panel downwardly out of rabbet 62. A new panel 20 can then be inserted into rabbet 62, and secured to studs 14.

Building structure 10 of the present invention is also designed to be constructed with maximum utilization of the building materials. As top frame member 50 and board member 70 form portions of the outer side wall of building structure 10, the dimensions of wall panel 20 may be reduced. Or, as is common in the industry, a building structure 10 having greater dimensions can be built using a standard cut wall panel 20. For example, wall panel 20 is typically cut from a sheet of material having a height of 8 feet. Using prior structural configurations, it would be necessary to cut panel 20 from the sheet of material having a height of 5 feet to produce a building having a side wall of 5 feet. This would leave a portion of the material having a height of 3 feet. This portion could not be used, as a building having an exterior wall height of 3 feet cannot be used.

These disadvantages are overcome by the present invention. For example, a sheet of material 8 feet in height could be cut to form two panels 20, each having a height of 4 feet. When placed in building structure 10 of the present invention, wall panels 20 would combine with top frame member 50 and board member 70 to form the outside wall member of the building structure. Thus, when wall panel 20 is 4 feet in height, the outside wall of building structure 10 will be approximately 5 feet in height. In this way, the entire sheet of material from which wall panel 20 is cut can be used, and two building structures 10 having outside wall heights of approximately 5 feet 6 inches may be constructed.

Of course, the sheet of material can be cut into different sized portions and still remain within the scope of the invention. For example, an 8 foot sheet of material can be cut to yield a first wall panel with a height of 3 feet 6 inches and a second wall panel with a height of 4 feet 6 inches. The 3 foot 6 inch wall panel would allow an outside wall height of approximately 4 feet 6 inches and the 4 foot 6 inch wall panel would allow an outside wall height of approximately 5 feet 6 inches. Likewise, different sizes of sheet material, such as a 4 foot by 7 foot sheet or a 4 foot by 9 foot sheet, can be used.

Utilizing the structural design of the present invention, building structure 10 can be produced at a lower cost while at the same time increasing its strength and decorative features. These advantages are achieved by reducing building material waste, and increasing the rigidity and strength of the framework. It will also be appreciated that other advantages are produced by the present invention, such as design flexibility.

Although the invention has been described and illustrated in detail, it is to be clearly understood that the same is by way of illustration and example only and is not to be taken by way of limitation. Therefore, the spirit and scope of this invention are to be limited only by the terms of the appended claims.

I claim:

1. A building structure having outer walls, a roof having a portion that overhangs at least one of said outer walls and a frame for supporting said outer walls and said roof, wherein said frame includes a plurality of spaced-apart studs and a top frame member having a top edge and a bottom edge, said top frame member being secured to said studs and forming a portion of said outer wall, a wall panel secured to said studs adjacent said bottom edge of said top frame member, and a board member having first and second edges, said board member being secured to said studs wherein said first edge of said board member is disposed adjacent said top edge of said top frame member, and said second edge of said board member is disposed adjacent said roof, such that said outer wall comprises said board member, said top frame member and said wall panel, said board member having a plurality of holes therein such that air may pass therethrough.

2. The building structure of claim 1 wherein said top frame member includes first and second rabbets therein, said first rabbet for securing a top edge of said wall panel, said second rabbet for receiving said first edge of said board member.

3. The building structure according to claim 1 further including a plurality of spaced-apart rafter tails secured to said studs, said rafter tails overhanging said outer wall and terminating with a distal end spaced outwardly from the outer wall and with said rafter tails being supported by said top frame member.

4. The building structure according to claim 3 including a roof deck extending from said roof, said roof deck overhanging said outer walls, having a distal end spaced outwardly from said outer walls and being secured to said plurality of rafter tails.

5. The building structure according to claim 4 including a vertically extending facia board secured to the distal end of said plurality of rafter tails, wherein said facia board has a top edge located adjacent the distal end of said roof deck.

6. The building structure according to claim 5 wherein two successive rafter tails, said roof deck and said facia board form a chamber therebetween to define an air flow path into said chamber and out through the holes in said board member and into said building structure.

7. A building structure having outer walls, a roof, a frame for supporting said outer walls and said roof, said frame including a plurality of spaced-apart studs, comprising:

a top frame member attached to said studs;

at least one wall panel secured to said studs;

a plurality of spaced-apart rafter tails secured to said studs, said rafter tails overhanging said outer wall and terminating with a distal end spaced from said wall;

a roof deck extending from said roof, said roof deck overhanging said outer wall and said rafter tails, said roof deck being secured to said plurality of rafter tails; and a vertically extending facia board secured to the distal end of said plurality of rafter tails and having a top edge adjacent the distal ends of said rafter tails.

8. The building structure according to claim 7, further including a board member secured to said studs, said board member being disposed substantially between said top frame member and said roof.

9. The building structure according to claim 8 wherein said board member has a plurality of holes therein such that air may pass therethrough.

10. The building structure according to claim 9 wherein said outer wall comprises said board member, said top frame member and said wall panel.

11. The building structure according to claim 10 wherein said top frame member includes first and second rabbets therein, said first rabbet for receiving a portion of said wall panel, said second rabbet for receiving a portion of said board member.

12. The building structure according to claim 9 wherein said facia board, said roof deck and two successive rafter tails form a chamber therebetween to define an air flow path into said chamber and from there through said board and into said building structure.

13. A building structure having outer walls, a roof, a frame for supporting said outer walls and said roof, said frame including a plurality of vertically extending spaced apart studs and a top plate attached to the studs on an upper end thereof, said outer wall comprising: a panel means attached to the studs, a board member attached to the studs and the top plate, and a top frame attached to the studs and extending between the panel means and the board member, the roof overhanging said studs, top plate and outer wall, and said board member being provided with a plurality of holes to allow for air passage into the building at points below the top plate.

14. The building structure of claim 13 wherein the board member extends vertically and the holes are horizontal.

15. The building structure of claim 13 wherein the roof has an outer edge which extends beyond the outer wall and below the top plate so as to overhang at least some of the holes in the board member.

16. The building structure of claim 14 wherein the roof has an outer edge which extends beyond the outer wall and below the top plate so as to overhang at least some of the holes in the board member.

17. The building structure of claim 14 wherein a facia board extends downward from the outer edge of the roof a sufficient distance to overhang all of the holes in the board member.

18. The building structure of claim 15 wherein a facia board extends downward from the outer edge of the roof a sufficient distance to overhang all of the holes in the board member.

19. The building structure of claim 16 wherein a facia board extends downward from the outer edge of the roof a sufficient distance to overhang all of the holes in the board member.

* * * * *